US005437594A

United States Patent [19]

Mattson et al.

[11] Patent Number: 5,437,594

[45] Date of Patent: Aug. 1, 1995

[54] PROCESS FOR APPLYING A HANDLE

[75] Inventors: Larry J. Mattson, Charlotte, N.C.; John T. Roberts, Clover, S.C.; Claude E. Monsees, Charlotte, N.C.; Les J. Kanna, Lancaster, S.C.

[73] Assignee: Roberts Systems Inc., Charlotte, N.C.

[21] Appl. No.: 242,698

[22] Filed: May 13, 1994

Related U.S. Application Data

[63] Continuation of Ser. No. 49,152, Apr. 19, 1993, abandoned, which is a continuation-in-part of Ser. No. 964,790, Oct. 21, 1992, abandoned, which is a continuation-in-part of Ser. No. 978,123, Nov. 18, 1992, Pat. No. 5,318,218.

[51] Int. Cl.[6] ..... B31B 1/86

[52] U.S. Cl. ..... 493/88; 156/568; 156/571; 156/572; 493/226

[58] Field of Search ..... 493/84, 88, 221, 226; 156/567, 568, 570, 571, 572, 582; 53/413, 134.1

[56] References Cited

U.S. PATENT DOCUMENTS

| | | | |
|---|---|---|---|
| 1,524,399 | 1/1925 | Krueger | 493/88 |
| 2,170,068 | 8/1939 | Taylor et al. | 156/568 |
| 3,549,459 | 12/1970 | Whitecar | 156/572 |
| 3,626,879 | 12/1971 | Heisler | 493/88 |
| 3,943,029 | 3/1976 | Mundt et al. | 156/571 |
| 4,027,578 | 6/1977 | Varca et al. | 493/122 |
| 4,767,739 | 8/1988 | Herring | 493/88 |
| 4,816,014 | 3/1989 | Bratton et al. | 493/88 |
| 5,095,683 | 3/1992 | Roberts et al. | 53/413 |
| 5,112,430 | 5/1992 | Hudson | 156/567 |

FOREIGN PATENT DOCUMENTS

| | | | |
|---|---|---|---|
| 464561 | 4/1950 | Canada | 493/88 |

*Primary Examiner*—Jack W. Lavinder
*Attorney, Agent, or Firm*—Hardaway Law Firm

[57] ABSTRACT

A continuous motion apparatus for installing handles onto cartons includes a handle dispenser and a handle conveyor. The handle conveyor comprises a track associated with an overhead belt in a pronged pick-up arm. The pick-up arm inserts through a handle and carries a handle to a surface of the carton, where a pair of rollers in a curved plow engage the handle and force it from the pick-up arm. The arm rotates in time sequence with the belt.

3 Claims, 6 Drawing Sheets

PROCESS FOR APPLYING A HANDLE

RELATED APPLICATIONS

This application is a continuation of application Ser. No. 08/049,152, filed Apr. 19, 1993 now abandoned which is a continuation-in-part of U.S. Ser. Nos. 07/964,790 filed Oct. 21, 1992, now abandoned and 07/978,123 filed Nov. 18, 1992 now U.S. Pat. No. 5,318,218 directed towards a pop-up handle and handle with latching means.

BACKGROUND OF THE INVENTION

This invention is directed towards an apparatus for the high speed installation of handles onto a container such as carton stock. A variety of handle installation equipment is known in the art. U.S. Pat. No. 5,095,683 to Roberts describes a method and apparatus for installing bayonet handles into carton blank stock. Recent improvements in new handle designs and features are not readily compatible with existing handle applicator equipment. Therefore, there is room for variation and improvement within the art of applicator equipment for installing handles.

SUMMARY OF THE INVENTION

It is an object of this invention to provide a high speed, continuous flow handle applicator for the installation of "pop-up" type handles.

It is a further object of this invention to provide a handle applicator which removes and transports a single handle from a supply of similar handles.

It is a further and more particular object of this invention to provide an arm for engaging and delivering the handle to a desired location upon a carton.

It is yet a further and more particular object of this invention to provide a handle applicator which provides a pivoting arm for varying the orientation of a handle upon a carton.

These as well as other objects of this invention are provided by an applicator for receiving an individual handle from a supply of similar handles and placing the handle upon a container, the applicator comprising: a guide means for positioning a container blank in a receiving position; a handle dispensing means for removing the single handle from a supply of like handles; a conveying means for the transport of the single handle; an arm having a first free end and a second attached end, the second end in communication with a drive means, the free end further comprising an engaging tip for engaging and delivering a handle to a surface of a carton; and, disengaging means for removing the handle from the engaging tip.

DETAILED DESCRIPTION

Figure 5:
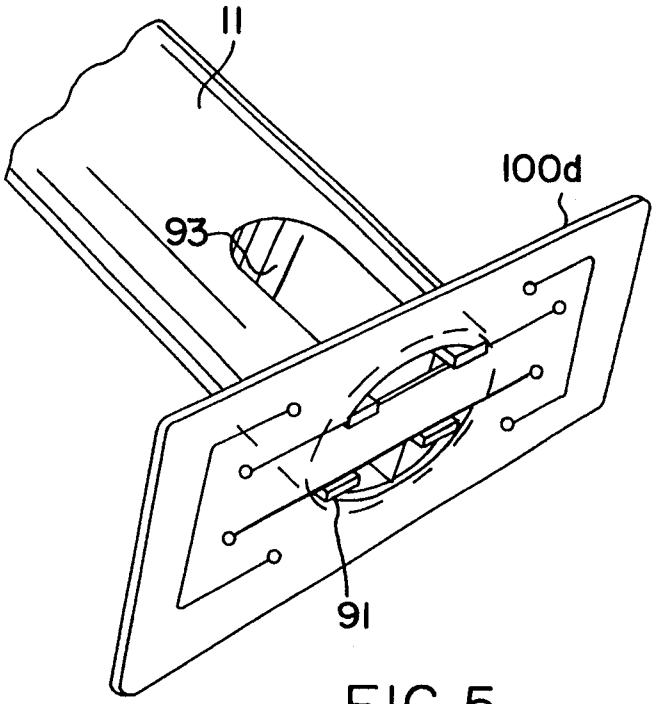
FIG. 5 of the drawings is a perspective view of a preferred embodiment of the pop-up handle as seen in relation to a carrying end of the handle pick-up arm.

As seen in reference to FIGS. 1 through 5, the preferred method and apparatus for the installation of a pop-up handle is presented. The current invention is best understood in reference to the pop-up handle and pop-up handle and latching means as described in pending U.S. patent application Ser. Nos. 07/964,790 and 07/978,123, incorporated herein by reference. The pop-up handle, seen in FIG. 5, is preferably constructed from plastic and comprises a platform defining an aperture, the aperture being traversed by a strap. One or more ends of the strap is connected to a flexible hinge which permits the strap to be displaced from the plane of the platform when the strap is engaged by the user. If desired, a latch may attach to an edge of the handle as taught and illustrated in the above-referenced patent application.

Figure 1:
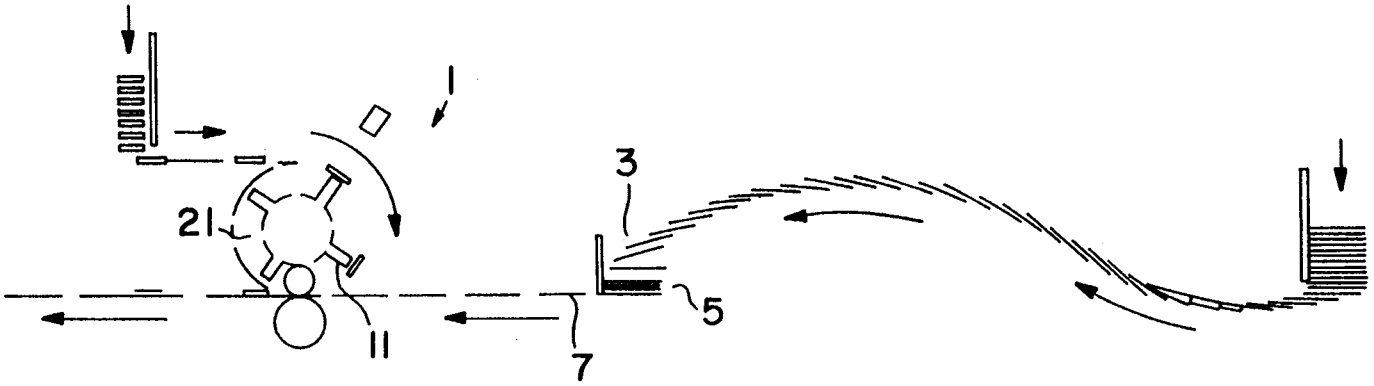
FIG. 1 of the drawings is a conceptual view of a process of applying handles to carton blank stock in accordance with this invention.
Figure 2:
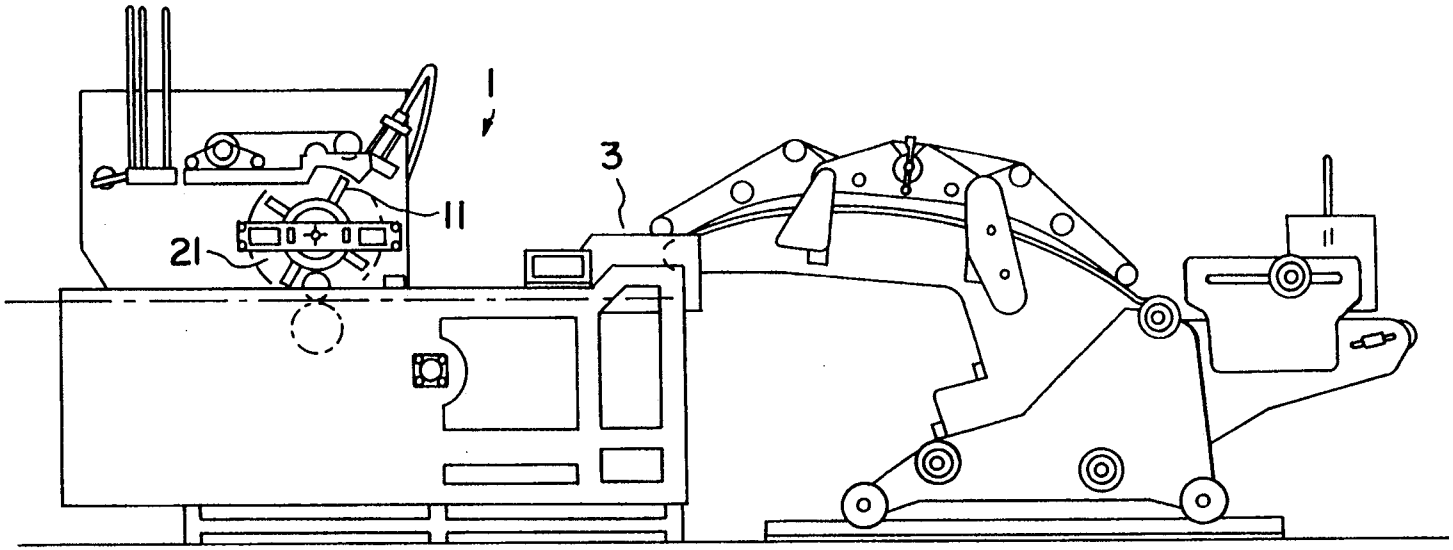
FIG. 2 of the drawings is a side elevation of a handle applicator in conjunction with a carton blank conveyor used to carry out the process seen in FIG. 1.
Figure 3:
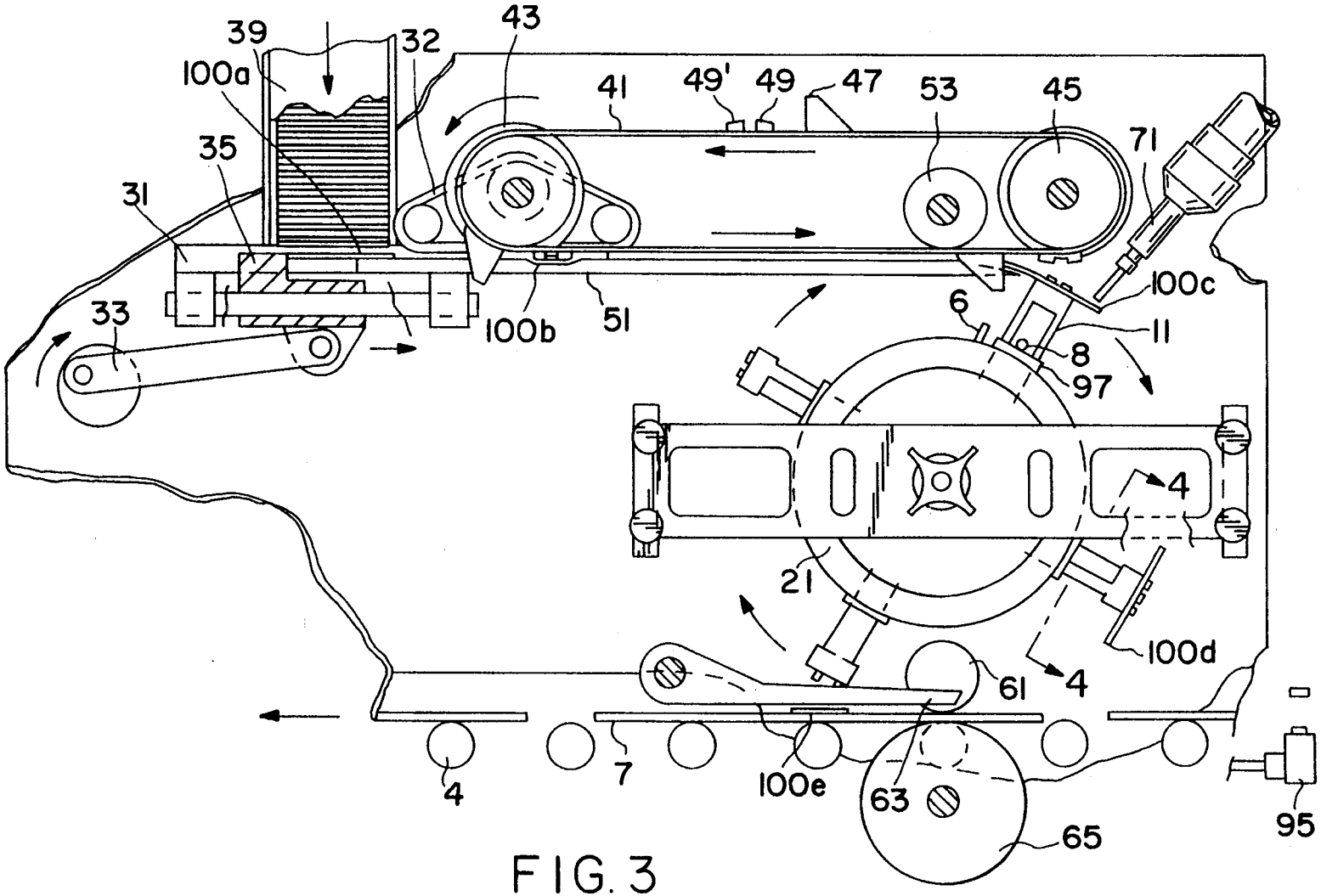
FIG. 3 of the drawings is a side elevation of a preferred embodiment of a handle applicator showing additional details of the handle supply means and the handle installation means.

As best seen in reference to FIGS. 1 through 3, handle dispensing apparatus 1 comprises a carton blank receiving end 3 for receiving and retaining a supply of carton blank stock 5. As seen in FIG. 2, a carton prefeeder apparatus, such as the one described in U.S. patent application Ser. No. 07/775,711, incorporated herein by reference, is a preferred apparatus for the high speed feeding of carton blank stock to receiving end 3. However, conventional conveyors and other well known biasing means will suffice.

As seen in FIG. 1, a single carton blank 7 is removed from supply stock 5 by well known blank conveying means 4 such as belts or wheels. Individual carton blanks 7 are sequentially placed in a handle engaging position beneath a wheel 21. Wheel 21 rotates clockwise as seen in reference to FIG. 3 and carries a plurality of rotating arms 11 carried by the exterior circumferential surface of wheel 21.

Positioned above wheel 21 is a handle dispensing means 31 comprising a reciprocating drive means 33 connected at one end to an engaging plate 35. Plate 35 engages a single handle along a handle edge, thereby biasing a single handle 100a from the dispensing magazine 39. A preferred method and apparatus for dispensing handles from the retaining magazine is described in U.S. Pat. No. 4,946,536 to Roberts, incorporated herein by reference. The single handle is dispensed into position 100*b* within a track 51 located beneath an overhead belt 41. A pair of belts 32, in communication with the drive means of belt 41, facilitates the positioning and initial transport of a singulated handle 100*a* from magazine 39 to track 51. Belt 41 is driven by two sprockets, 43 and 45. The outer surface of belt 41 defines a lug 47, lug 47 being in spaced alignment with a pair of cleats 49 and 49'.

With respect to FIG. 3, a series of handle positions seen as 100*a* through 100*e* are illustrated. It is understood that the preferred embodiment of the handle dispensing apparatus is a continuous motion apparatus such that the indicated handle positions are not static but merely indicative of various handle positions to better inter-relate the cooperating components of the apparatus. As such, handles 100*a* through 100*e* are shown at several different locations. In operation, a handle would not actually be present at each illustrated location at any one instance.

The pop-up handle 100*b* is positioned within track 51 so that cleats 49 and 49' are positioned above the aperture of the handle. Lug 47 biases an edge of the handle, directing the handle along track 51 in timed relation to the speed of belt 41. As handle 100*c* approaches the end of track 51, an arm 11 rotates in timed sequence to the speed of belt 41 whereby the free end of arm 11 engages the handle by insertion of its free end into the handle aperture.

For purposes of illustration and clarity, handle 100*b* & 100*c* (FIGS. 3 & 6) are shown with the handle strap slightly displaced from the plane of the handle. However, in the preferred embodiment of the invention, the handle strap is substantially flush with the handle. Adjacent cleats 49 & 49' are positioned adjacent the strap to insure that upon insertion of the arm through handle 100*c*, the strap remains in a fixed position for engagement.

Figure 6:
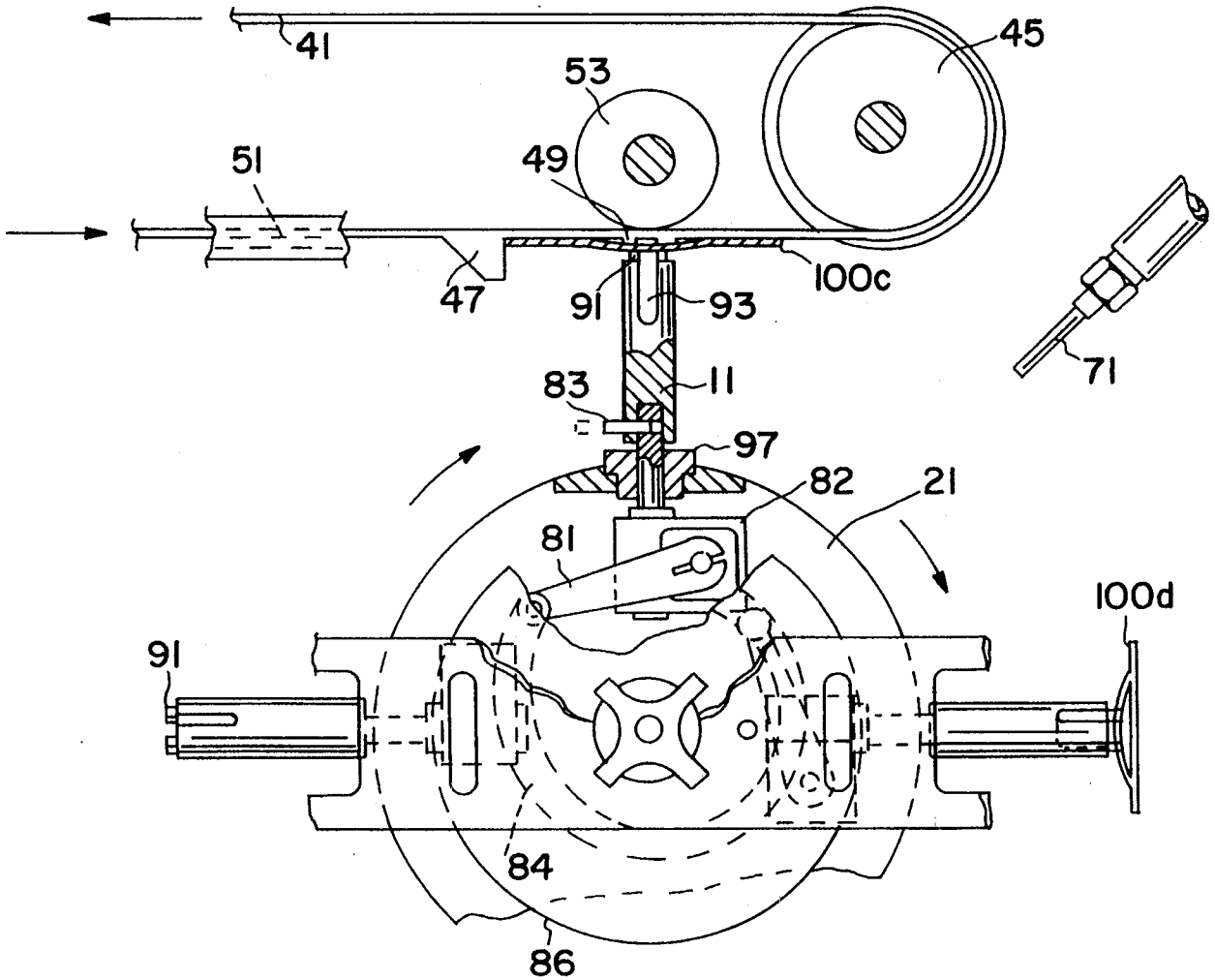
FIG. 6 of the drawings, similar to FIG. 3, illustrates additional details of the invention.
Figure 7:
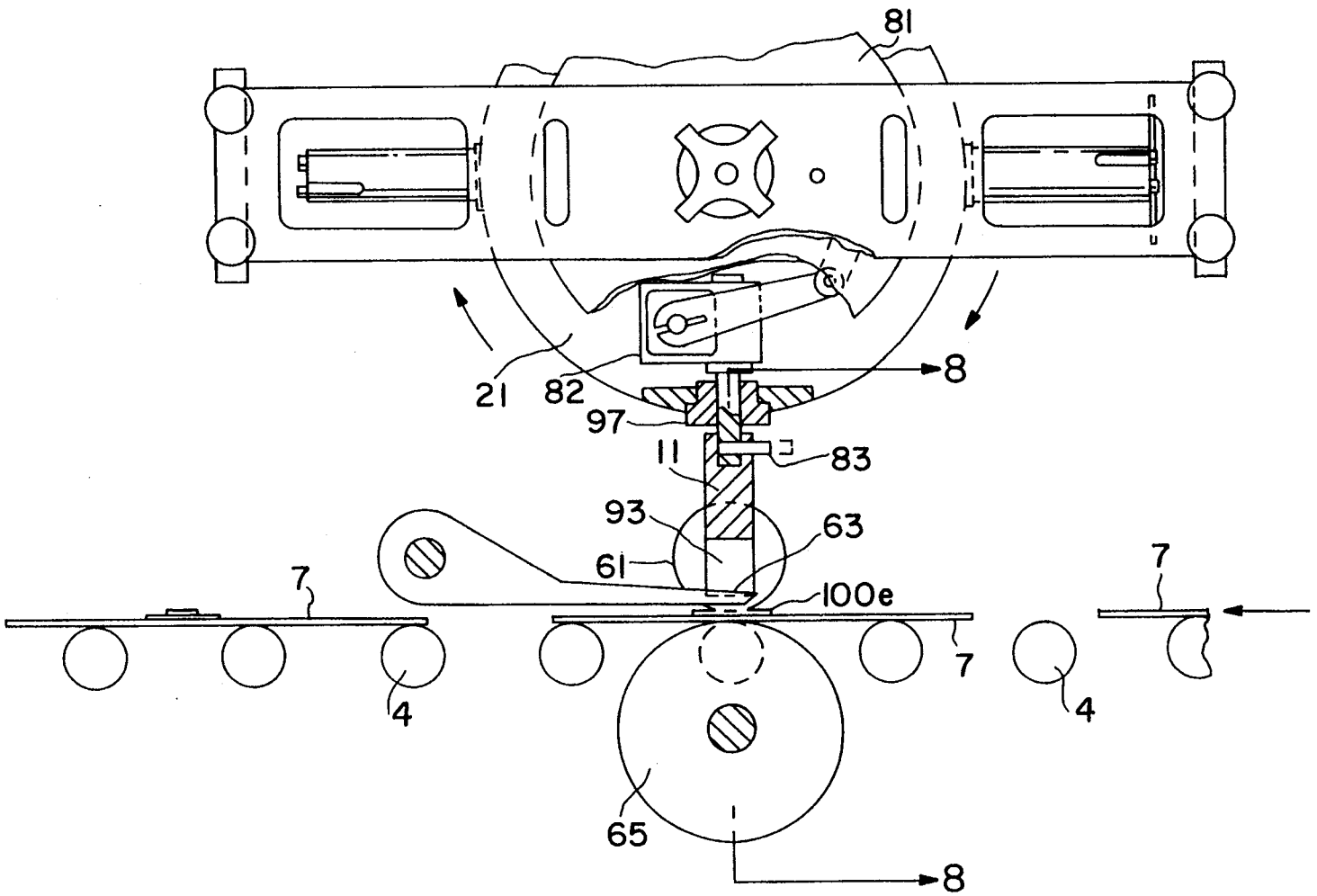
FIG. 7 of the drawings, similar to FIG. 3, illustrates additional details of the invention.
Figure 8:
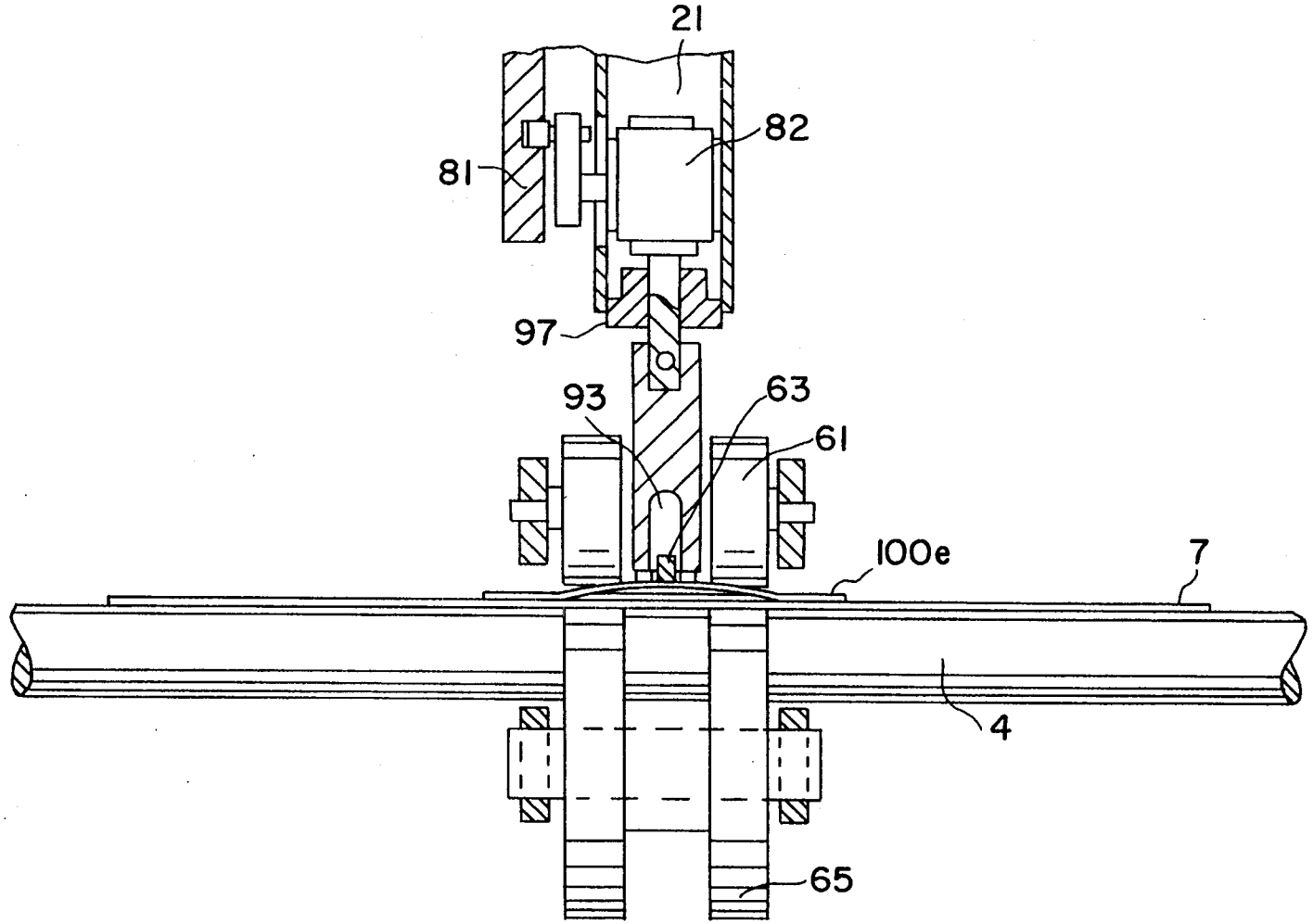
FIG. 8 of the drawings is a sectional view as seen along line 8—8 of FIG. 7.

To facilitate the insertion of arm 11 through the opening defined by a pop-up handle, a roller 53 is positioned against the inner surface of belt 41 in proximity to where a pop-up handle is engaged by arm 11. As best seen in FIG. 6, Roller 53 secures belt 41 and associated handle so that arm 11 can be inserted through the handle opening without any upward flexing of the handle transporting region of belt 41. As arm 11 directs the handle away from conveying means 41, an adhesive is applied to the handle surface by adhesive applicator 71, prior to the handle being placed against carton blank stock 7.

Disengaging means comprising a pair of adjacent rollers 61 permits the passage of arm 11 between the rollers, rollers 61 disengaging the handle from arm 11. As seen in reference to figure 3, rollers 61 are in close proximity to an upper surface of the carton stock 7 thereby insuring contact between handle 100*e* and the appropriate surface of carton stock 7.

A curved plow 63 is positioned between rollers 61, the handle passing beneath plow 63 thereby insuring the detachment of the handle from the arm. Rollers 61 and carton rollers 65 together provide a pair of nip rollers through which the handle and carton pass, thereby spotting the adhesive backed handle to the desired carton location.

As seen in reference to FIG. 5, the preferred embodiment of the free end of arm 11 is illustrated in which the free end comprises a four pronged terminus, each prong 91 configured so as to traverse a portion of the handle aperture. Prongs 91 are configured to mate with the handle portion surrounding the aperture, the strap passing between opposing pairs of prongs 91. A snug, mated fit between the prongs, the aperture openings and the strap, permit frictional engagement of the handle by the prongs 91. The frictional engagement also facilitates the removal of the handle from the prongs by disengagement means 61 and plow 63.

It should be appreciated that a variety of various styled handle configurations and aperture designs can be used with an appropriate designed arm and prong arrangement. Prongs 91 preferably engage a pop-up handle through the handle aperture, the aperture and strap serving as a template for the prongs 91. This feature permits the handle edges to be free to serve as guides for retaining the handles along track 51. The preferred embodiment of opposing pairs of prongs defines a series of gaps 93 separating each prong. Gaps 93 permit the passage of plow 63 between the prongs 91.

Upon the delivery handle of handle 100e to carton stock 7 via the disengagement means of rollers 61 and plow 63, arm 11 continues rotation about wheel 21 thereby positioning arm 11 for receiving another handle from the overhead handle dispenser 31. Ideally, the drive means for wheel 21, handle dispensing means 31, handle conveyor 41 and carton blank conveying means 4 are synchronized by a common drive means. Interlinked drive means insures that proper synchronization is maintained in the continuous steps of separation, transport, delivery and spotting of handles in timed relation to the carton stock. Alternatively, one or more separate drive means can be employed in conjunction with servo-control means for maintaining proper synchronization.

As best seen in FIG. 3, a preferred embodiment of the invention has detection means 95 for monitoring the proper placement of a carton blank 7 so that handle 100*c* is placed in proper position. Should a misfeed or a misalignment occur, a signal from detector 95 can activate several corrective measures. For instance, detector 95 can interrupt the application of adhesive from applicator 71 so that adhesive does not contaminate the carton conveying portion of the equipment. A similar detector means can be provided in association with applicator 71 so that a failure for arm 11 to receive a handle 100 will interrupt the application of an adhesive.

Figure 4:
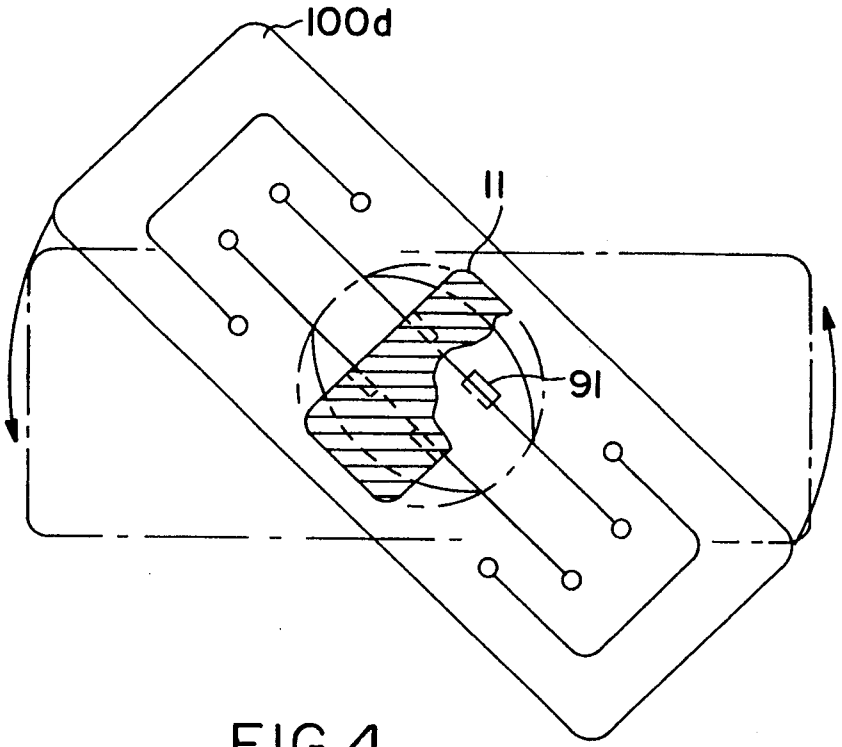
FIG. 4 of the drawings is a sectional view seen in the direction along lines 4—4 as seen in FIG. 3.

In reference to FIG. 3 and 4, the preferred embodiment of the invention provides a pivot means 97 for arm 11 such that arm 11 can pivot 90° about its handle receiving axis. Pivot means 97 enables arm 11 to receive a handle in a lengthwise manner from handle dispensing means 31. After arm 11 carries the handle past glue applicator 71, arm 11 pivots 90° thereby changing the orientation of the handle as applied to the carton. Upon the handle disengaging from arm 11, arm 11 then pivots to its original orientation for receiving an additional handle. Gaps 93 associated with prongs 91 permit the passage of arm 11 between plow 63 in either handle orientation.

Pivot means are provided for each arm 11 by four separate right angle gear mechanisms. Each right angle gear mechanism 82 is driven by a cam 81 engaged by a cam track 84, the cam track defined by an interior surface of a housing 86, of wheel 21. In the preferred embodiment of the invention, a two to one gear ratio is used so that a 45° rotation of cam 81 produces a 90° pivot of arm 11. Therefore, the drive means rotating wheel 21 provides the camming action for the pivoting of arm 11. As wheel 21 rotates, the cam action enables each arm to pivot 90° relative to its axis as the arm swings downward to deliver the handle to the carton stock. Upon delivery of the handle, the camming action then pivots the arm to its original position for receiving another handle.

The pivoting action can be locked by disengaging a locking pin 83 which links the gear mechanism to arm 11. This feature permits the spotting of the handle to the carton at a position 90° from where a pivoting arm would spot the handle.

As seen in FIG. 3, a mechanical stop is provided upon the outer circumference of wheel 21. Stop 6 engages an extended member 8 of arm 11 to provide a precise mechanical alignment means to insure arm 11 is properly positioned following the initial pivoting of arm 11. The interaction of the pivot motion of arm 11 with a mechanical stop insures a precise arm positioning for spotting the associated handle. The mechanical stop insures that slight variations and position tolerances inherent in right angle gear box mechanisms does not contribute to a misalignment of the handle relative to the carton stock.

The pivot means of arm 11 provides a selective means for varying the orientation of the handle as presented to the carton blank. Since various orientations are desired in response to different carton stock, pivot means 97 permits a rapid means of changing the installed handle orientation relative to the carton blank. This versatile placement ability allow a variety of possible handle positions without any mechanical or positional changes to the handle dispensing means, handle conveying means, glue applicator or carton conveying apparatus.

While the specification of the present invention is given in reference to a pop-up type handle, it is understood that variations in designs of handles are within the present scope of the current invention. Pop-up handles having latching tabs as referenced in this description are readily accommodated by the present invention. In addition, older, established handle designs could be modified with a necessary opening to enable arm 11 to engage such handles for use in the present invention.

Therefore, it is understood that the above description and drawings are exemplary in nature and that various modifications and changes may be made to the instant invention without departing from the spirit and scope of the invention as defined by the following appended claims.

That which is claimed:

1. A process of installing a handle having an aperture to a carton comprising:

supplying a handle;

providing a handle pick-up arm, a terminus of said pick-up arm defining a template for mated insertion through an aperture of said handle;

positioning said handle in a first position in proximity to said pick-up arm;

inserting said terminus of said pick-up arm through said handle;

frictionally engaging said handle to said pick-up arm by:

inserting a first pair of prongs and a second pair of prongs defined by said terminus through said handle, said handle having a strap traversing said handle aperture, said strap engaging a gap defined by each pronged pair;

rotating said pick,up arm carrying said handle to a second position in proximity to a carton;

placing said handle on said carton;

disengaging said handle from said pick-up arm.

2. The process according to claim 1 wherein said step of disengaging said handle further comprises inserting a handle disengagement means through a second gap defined opposite each pronged pair, said disengagement means traversing said terminus through a spaced opening defined between an upper surface of a handle attached to said pick-up arm and said pick-up arm itself.

3. A process of installing a handle having an aperture comprising:

supplying a handle having an aperture;

providing a handle mover;

positioning said handle on said mover at a first position by engagement of said aperture by said mover;

moving said handle from said first position to a second position by rotating said handle mover, said second position immediately adjacent a point on a carton where said handle is to be installed;

pivoting said handle mover along an axis of said mover for varying the orientation of said handle relative to said carton;

disengaging said handle from said mover while said handle is at said second position.

* * * * *